US006438823B2

(12) United States Patent
Yamakawa

(10) Patent No.: US 6,438,823 B2
(45) **Date of Patent: *Aug. 27, 2002**

(54) ELECTRICAL TERMINAL FASTENING DIES FOR FASTENING A CONDUCTOR TO A TERMINAL

(75) Inventor: Nobuaki Yamakawa, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,255

(22) Filed: Jun. 30, 1999

(30) Foreign Application Priority Data

Jul. 6, 1998 (JP) ..... 10-190679

(51) Int. Cl.[7] ..... H01R 43/042

(52) U.S. Cl. ..... 29/753; 29/748; 29/751; 29/761; 29/33 M; 29/863; 29/865; 72/416

(58) Field of Search ..... 29/753, 751, 863, 29/857, 761, 283.5, 282, 865–867, 748, 749, 795, 796, 788, 33 F, 33 M; 72/415, 416, 412, 409.14, 712, 402, 409.19, 357

(56) References Cited

U.S. PATENT DOCUMENTS 4,261,194 A * 4/1981 Stephens ..... 72/402
4,890,384 A * 1/1990 Shaffer ..... 29/863

OTHER PUBLICATIONS

Japanese U.M. Reg. Appln. Laid–Open No. 51–1504 published Jan. 8, 1976.
Japanese Patent Application Laid–Open No. 10–22040 published Jan. 23, 1998.

* cited by examiner

*Primary Examiner*—Rick K. Chang
(74) *Attorney, Agent, or Firm*—Armstrong, Westerman & Hattori, LLP

(57) ABSTRACT

Electrical terminal fastening dies are provided, which includes: an electric wire; an electrical terminal having the electric wire; a couple of dies to press the electrical terminal a substantially hexagon in cross section; an abutting plane provided on each of the couple of dies; a pressing groove provided on the abutting plane and having a section to be formed by dividing a hexagon symmetrically with a diagonal; a pair of terminal pressing planes formed on a surface of the pressing groove of at least either one of the couple of dies for pressing the electrical terminal; and a pair of flash preventing planes formed on the surface of the pressing groove having the pair of terminal pressing planes, and each connected to the abutting plane, for pressing the electrical terminal to form thin portions thereon so as to prevent a flash from arising on the electrical terminal. Further, an electrical terminal fastening method is provided, which includes the steps of: inserting an electric wire into an electrical terminal; putting the electrical terminal between pressing grooves formed on a couple of dies; and pressing the electrical terminal a substantially hexagon in cross section by the couple of dies so as to fastening the electrical terminal to the electric wire.

2 Claims, 6 Drawing Sheets

ELECTRICAL TERMINAL FASTENING DIES FOR FASTENING A CONDUCTOR TO A TERMINAL

BACKGROUND OF THE INVENTION

1. Field of the Invention

The present invention generally relates to electrical terminal fastening dies and a electrical terminal fastening method to be applied to e.g. an electric vehicle, wherein an exposed conductor of an electric wire is inserted into an electrical terminal and the conductor is fastened to the terminal.

2. Description of the Related Art

A fastening method of an electrical terminal 80 as in FIGS. 9A–9C has been proposed.

According to the method, as shown in FIG. 9A, a conductor 81 of an electric wire (not shown) is exposed, the conductor 81 is inserted into the electrical terminal 80 having a circular section, and the electrical terminal 80 is arranged between a couple of dies 82 each having a pressing groove 83 with a section formed by symmetrically dividing a hexagon. And, as shown in FIG. 9B, the electrical terminal 80 is fastened to the conductor 81 by closing the pair of dies 82. The fastened terminal 80 has a hexagonal section.

However, since a material is apt to flash between abutting planes 82*a* of the couple of dies 82 when the electrical terminal 80 is fastened, a flash 84 would arise on both sides of an fastened electrical terminal 80' as shown in FIG. 9C. This needs work of cutting the flash 84 in order to satisfy a standard.

Therefore, another fastening method shown in FIG. 10 disclosed in Japanese Patent Application Laid-open No. 10-22040 (hereinafter, JP'040 ) has been proposed in order to prevent the flash 84. According to this fastening method, as shown in FIG. 10A, a couple of dies 82 form flash absorbing grooves 85 on an entrance side of a pressing groove 83, and as shown in FIG. 10B, a flash formed on the electrical terminal 80 is absorbed in the flash absorbing groove 85.

With respect to the above prior art fastening method of JP'040, however, as shown in FIG. 10C, since a pair of oppositely located round flashes 86 are formed on the fastened electrical terminal 80" and in the respective flash absorbing grooves 85, a diagonal distance L including the pair of round flashes 86 is of nonstandardized one. Therefore, the fastened electrical terminal 80" satisfying a standard can not be obtained with the fastening work.

SUMMARY OF THE INVENTION

In view of the foregoing, an object of the present invention is to provide electrical terminal fastening dies and an electrical terminal fastening method for forming an electrical terminal capable of easily satisfying a standard, wherein cutting work of a flash is not required after fastening work.

In order to achieve the above-described object, as a first aspect of the present invention, electrical terminal fastening dies includes: an electric wire; an electrical terminal having the electric wire therein; a couple of dies to press the electrical terminal a substantially hexagon in cross section; an abutting plane provided on each of the couple of dies; a pressing groove provided on the abutting plane and having a section to be formed by dividing a hexagon symmetrically with a diagonal; a pair of terminal pressing planes formed on a surface of the pressing groove of at least either one of the couple of dies for pressing the electrical terminal; and a pair of flash preventing planes formed on the surface of the pressing groove having the pair of terminal pressing planes, and each connected to the abutting plane, for pressing the electrical terminal to form thin portions thereon so as to prevent a flash from arising on the electrical terminal.

According to the above-described structure, since the pair of flash preventing planes are provided on the pressing groove, the thin portion can be formed on the electrical terminal instead of a flash conventionally formed.

As a second aspect of the present invention, in the structure with the above first aspect, the pair of flash preventing planes each have an inclination nearer the horizontal than that of the pair of terminal pressing planes for surely forming the thin portion and width between the connecting points of the abutting plane and the pair of flash preventing planes is defined equally to a specified dimension of a corresponding part of the electrical terminal as a finished product.

According to the above-described structure, since cutting work of a flash can be eliminated, the fastening work of an electrical terminal can be executed quickly.

As a third aspect of the present invention, in the structure with the above first or second aspect, a pressing projection is oppositely provided on each of the pressing grooves for forming a pair of opposite recesses on the electrical terminal so as to strongly pressing the electrical terminal to the electric wire.

According to the above-described structure, since the electrical terminal is strongly fastened to the electric wire by means of the pressing projections, movement of the electric wire in the electrical terminal can be prevented.

As a fourth aspect of the present invention, an electrical terminal fastening method includes the steps of: inserting an electric wire into an electrical terminal; putting the electrical terminal between pressing grooves formed on a couple of dies, respectively, the pressing grooves each having a section to be formed by dividing a hexagon symmetrically with a diagonal and at least one of the pressing grooves having a pair of flash preventing planes at an entrance thereof; and pressing the electrical terminal a substantially hexagon in cross section by the couple of dies so as to fastening the electrical terminal to the electric wire, wherein thin portions are formed on the electrical terminal so as to prevent a flash from arising on the electrical terminal.

According to the above-described structure, since the pair of flash preventing planes are provided on the pressing groove, the thin portion can be formed on the electrical terminal instead of a flash conventionally formed. Since cutting work of a flash can be eliminated, the fastening work of an electrical terminal can be executed quickly.

As a fifth aspect of the present invention, in the structure with the above fourth aspect, the electrical terminal is pressed by a pressing projection oppositely provided on each of the pressing grooves so as to strongly fasten the electrical terminal to the electric wire by forming a pair of opposite recesses on the electrical terminal.

According to the above-described structure, since the electrical terminal is strongly fastened to the electric wire, movement of the electric wire in the electrical terminal can be prevented.

As a sixth aspect of the present invention, in the structure with the above fifth aspect, the electrical terminal is pressed every 60 degrees three times by the couple of dies for forming three pairs of recesses on the electrical terminal so as to more strongly fastening the electrical terminal to the electric wire.

According to the above-described structure, since six recesses are formed on the electrical terminal, the electrical terminal can be more strongly fastened to the electric wire. And, the thin portion becomes shorter, the electrical terminal can be easily handled.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

FIGS. 1–8 show an embodiment of electrical terminal fastening dies in accordance with the present invention.

In the present embodiment, an electrical terminal with a circular section is formed into the terminal with a substantially hexagonal section.

Figure 1:
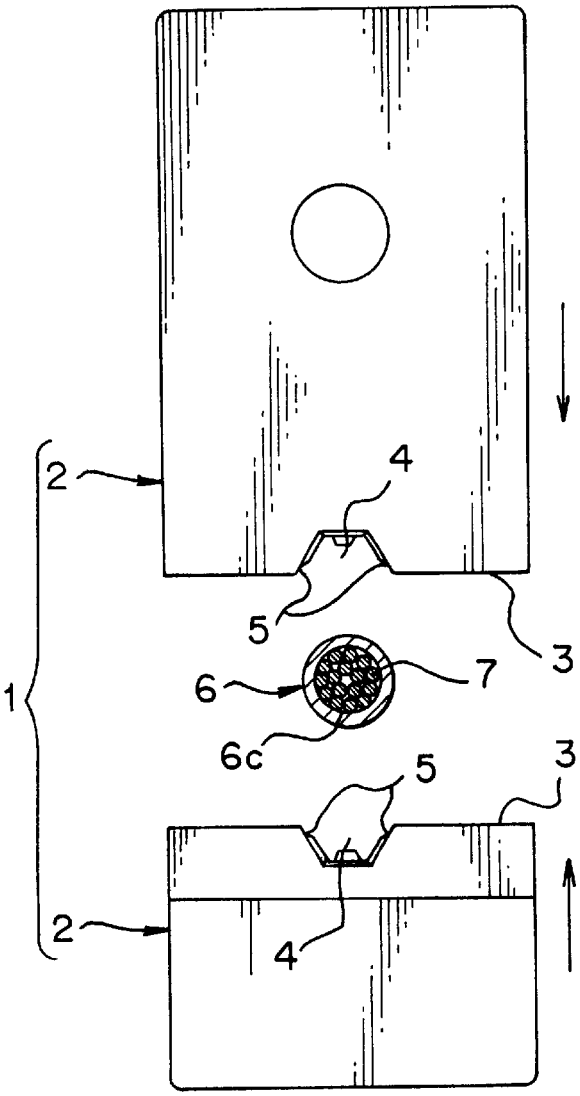
FIG. 1 is a front view showing an embodiment of electrical terminal fastening dies in accordance with the present invention.
Figure 2:
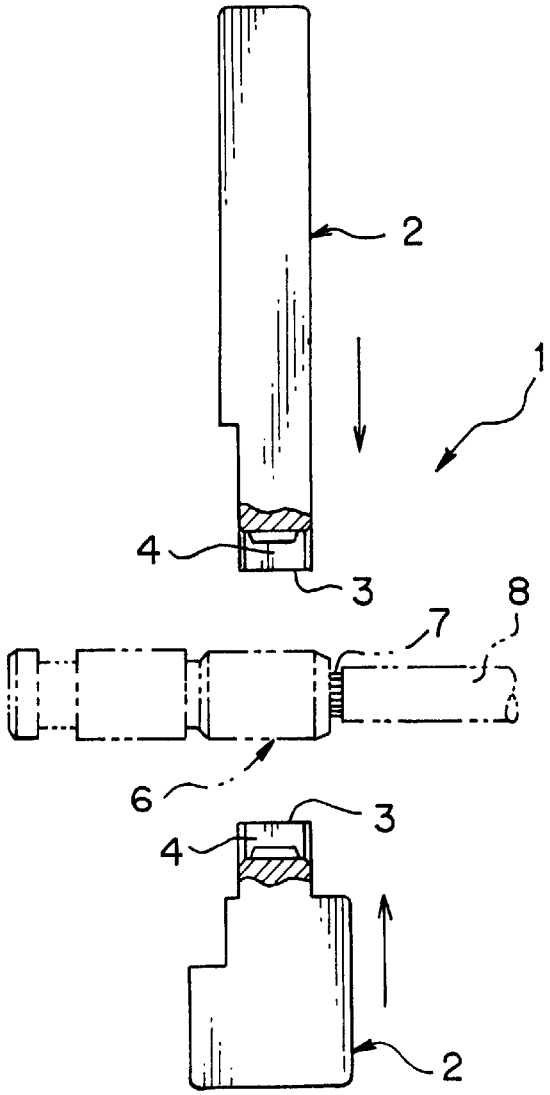
FIG. 2 is a right side view of FIG. 1.

As shown in FIGS. 1 and 2, electrical terminal fastening dies 1 consist of a couple of dies 2 facing each other, and each of the die 2 has an abutting plane 3 and a pressing groove 4 having flash preventing planes 5. By closing the couple of dies 2 in the arrow directions, an electrical terminal 6 with a circular section (hereinafter, circular electrical terminal) is formed into the terminal with a substantially hexagonal section, while fastening a conductor 7 therein.

The pressing groove 4 is formed by dividing a hexagon symmetrically with a diagonal. Therefore, when the dies 2 are closed, the pressing grooves 4 make the hexagonal. An area of this hexagonal is larger than that of the circular electrical terminal 6.

The lower die 2 in FIG. 1 is described hereinafter since the dies 2 have the same structure.

Figure 3:
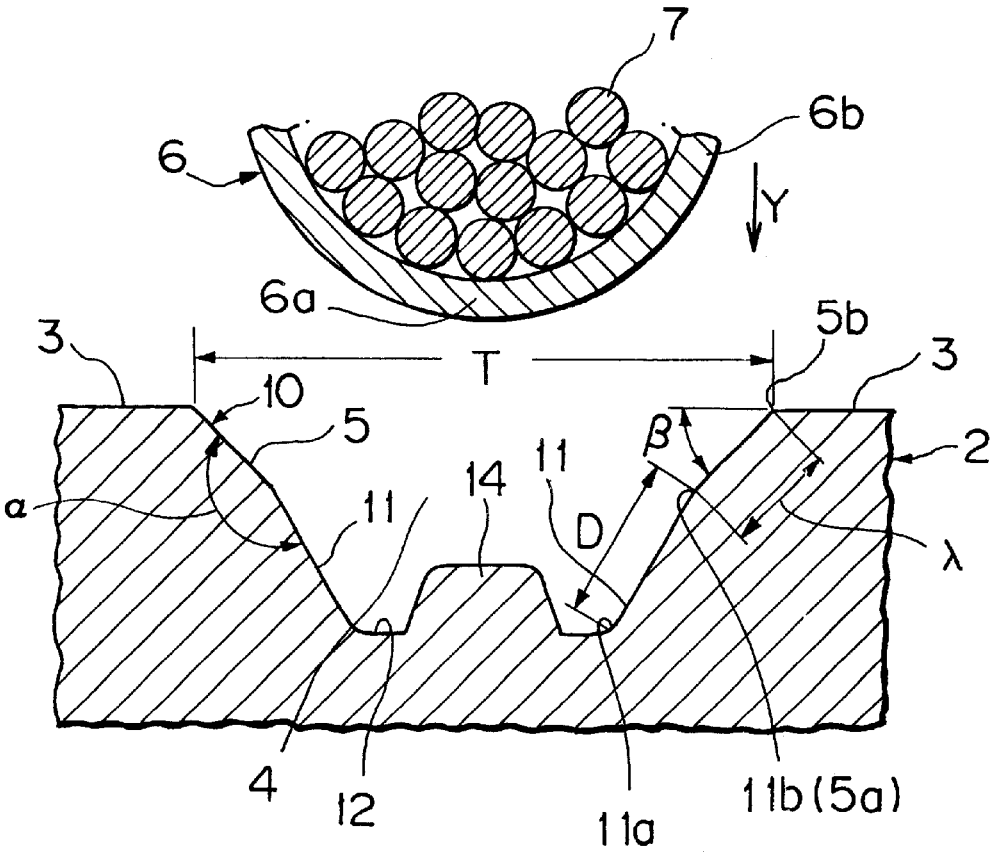
FIG. 3 is an enlarged cross-sectional view of a part of the lower die of FIG. 1.
Figure 4:
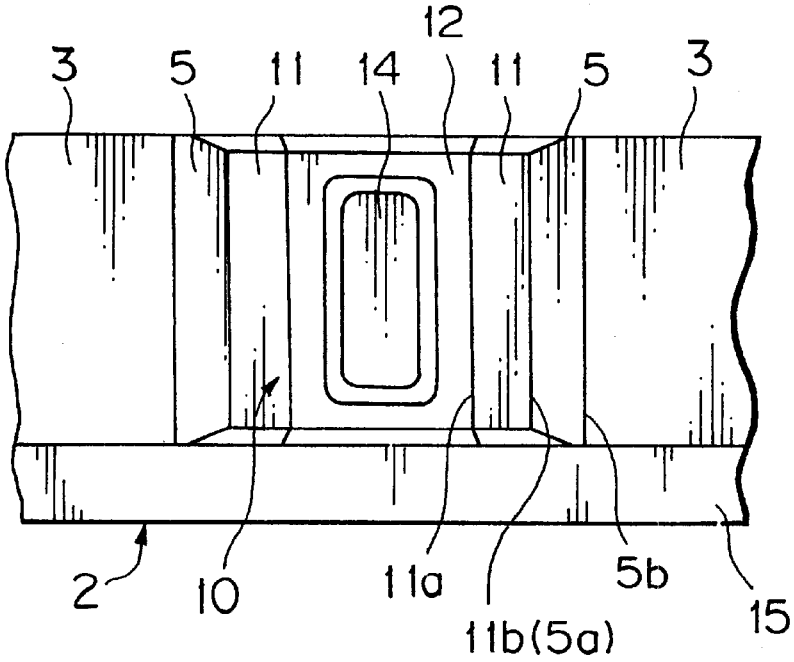
FIG. 4 is a top view, taken from an arrow Y of FIG. 3, of the lower die.

As shown in FIGS. 3 and 4, an inner surface 10 of the pressing groove 4 consists of a pair of terminal pressing planes 11 to directly press the circular electrical terminal 6, a pair of terminal pressing surfaces 12 to press a bottom portion 6*a* of the circular electrical terminal 6, and a pair of flash preventing planes 5 each formed between the terminal pressing plane 11 and the abutting plane 3.

In the middle of the terminal pressing surface 12, a pressing projection 14 projects inwardly.

Figure 10A:
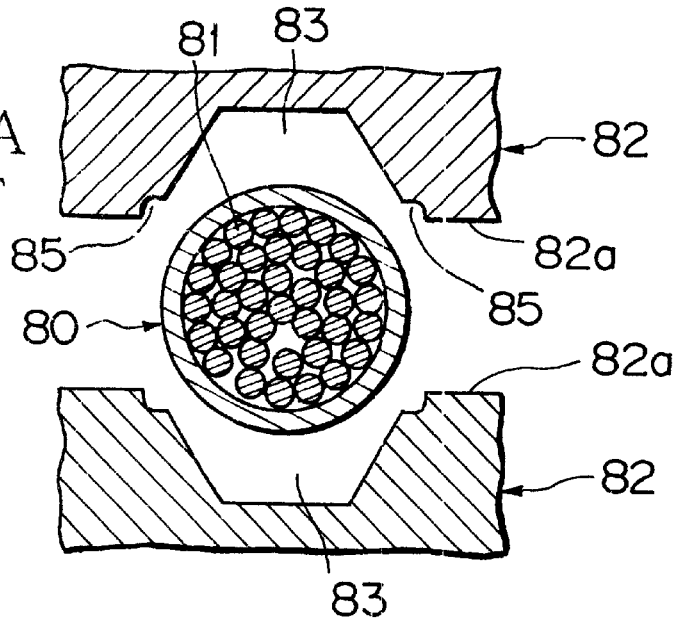
FIG. 10A PRIOR ART
FIG. 10A is a cross-sectional view showing another prior art electrical terminal fastening dies, being in an opened state, with a circular electrical terminal therebetween.
Figure 10B:
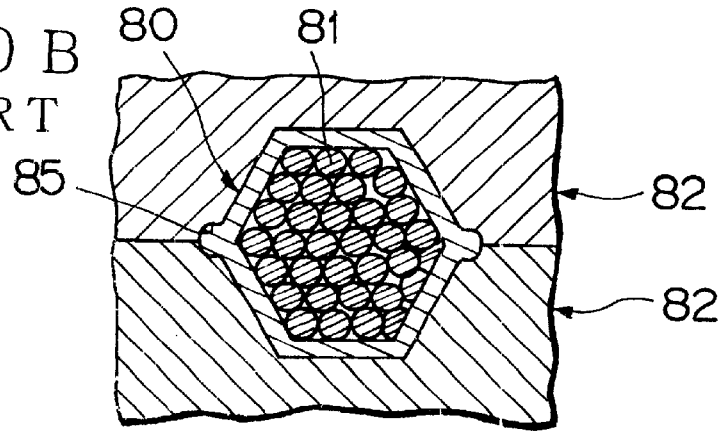
FIG. 10B PRIOR ART
FIG. 10B is a cross-sectional view of the dies of FIG. 10A in a completely closed state.
Figure 10C:
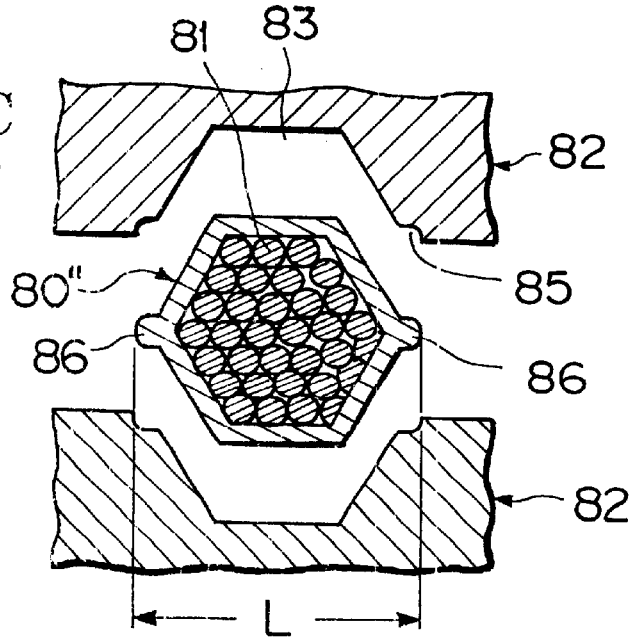
FIG. 10C PRIOR ART
FIG. 10C is a cross-sectional view showing a state that the dies of FIG. 10B are opened again.

The flash preventing plane 5 continues from the terminal pressing plane 11 and has a smaller inclination than that of the terminal pressing plane 11. The flash preventing plane 5 is provided not for absorbing the middle portion 6*b* of the circular electrical terminal 6 as is done in the prior art flash absorbing groove 85 (FIG. 10) but for pressing the circular electrical terminal 6 inside the pressing groove 4.

More specifically, as is shown in FIG. 3, a distance D of the terminal pressing plane 11 between the lower end 11*a* and the upper end 11*b* is approximately 3.78 mm. A distance $\lambda$ of the flash preventing plane 5 between the lower end 5*a* and the upper end 5*b* is approximately 2.46 mm. And, an angle $\alpha$ between the flash preventing plane 5 and the terminal pressing plane 11 is approximately 165 degrees. An angle $\beta$ between the flash preventing plane 5 and the abutting plane 3 is approximately 45 degrees. And, the inner surface 10 of the pressing groove 4 is, for example, hard chrome-plated and fabric-polished. The diagonal distance T between the upper ends 5*b* of the respective flash preventing planes 5 satisfies a standard width of the circular electrical terminal 6. Reference numeral 15 indicates a chamfer.

Next, a fastening method of the conductor to the circular electrical terminal 6 by the fastening dies 1 is described. A case of the lower die 2 is described, but a case of the upper die 2 is the same.

Figure 5:
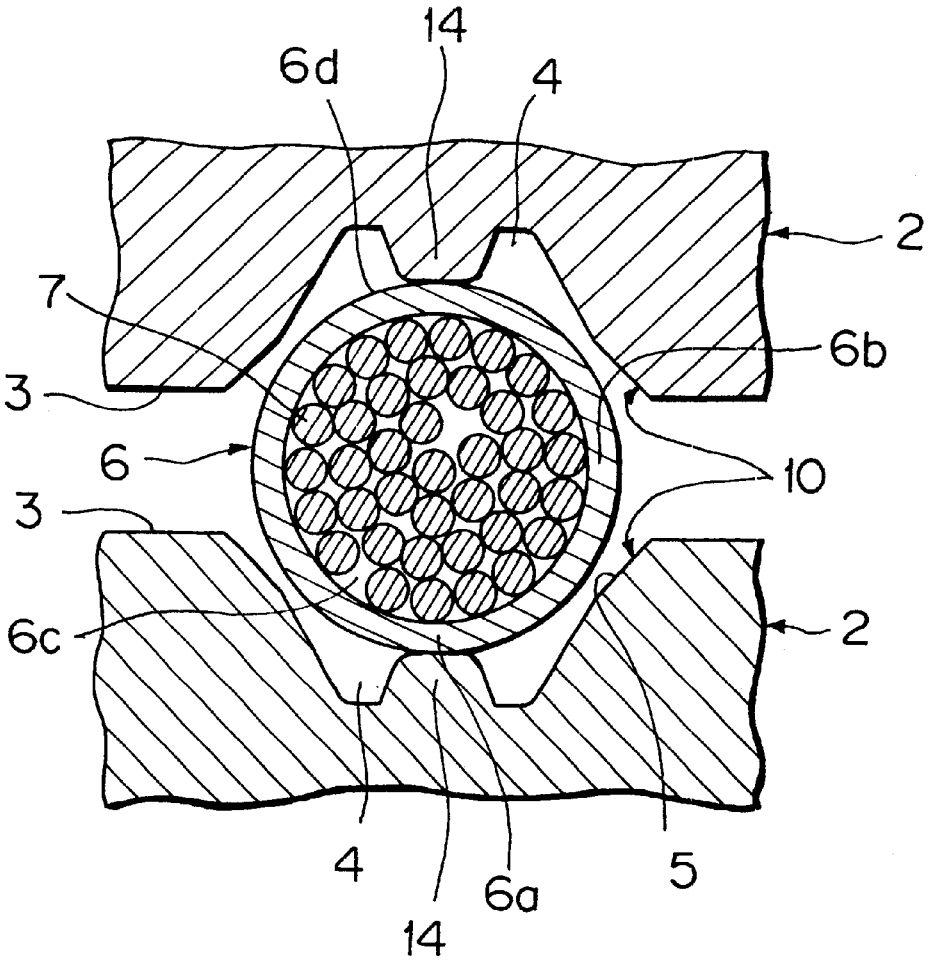
FIG. 5 is a cross-sectional view showing a state that the dies of FIG. 1 are put into contact with a circular electrical terminal.

As is shown in FIGS. 1 and 2, the conductor 7 of an electric wire 8 is exposed and inserted into an opening 6*c* of the circular electrical terminal 6. And then the circular electrical terminal 6 is arranged between the couple of dies 2. As shown in FIG. 5, the couple of dies 2 approach each other and then the circular electrical terminal 6 is accommodated in the pressing groove 4. The pressing projections 14 abut on the outer surface 6*d* of the circular electrical terminal 6.

Figure 6:
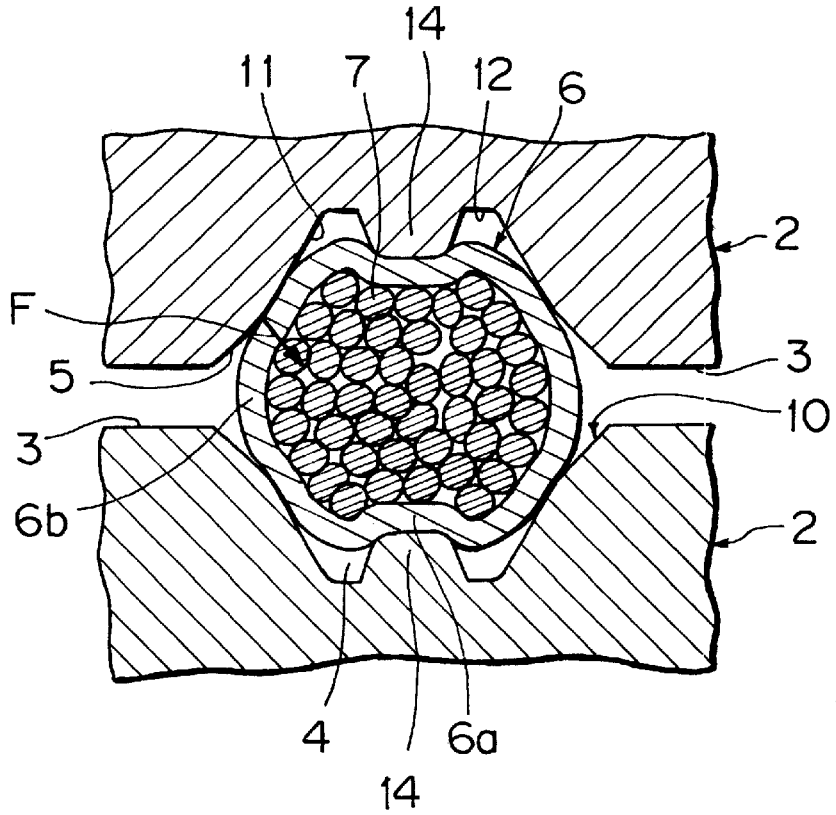
FIG. 6 is a cross-sectional view showing a state that the circular electrical terminal of FIG. 5 has been pressed and deformed.

And, as shown in FIG. 6, the pressing projection 14 starts to press the bottom portion 6*a* of the circular electrical terminal 6. The middle portion 6*b* is gradually pressed inward the pressing groove 4 by the flash preventing plane 5 and the terminal pressing plane 11, and the conductor 7 is gradually fastened. At this time, the flash preventing plane 5 receives pressure from the middle portion 6*b* of the circular electrical terminal 6, and the middle portion 6*b* receives external force F as a reaction from the flash preventing plane 5. The external force F acts perpendicularly on the flash preventing plane 5.

Figure 7:
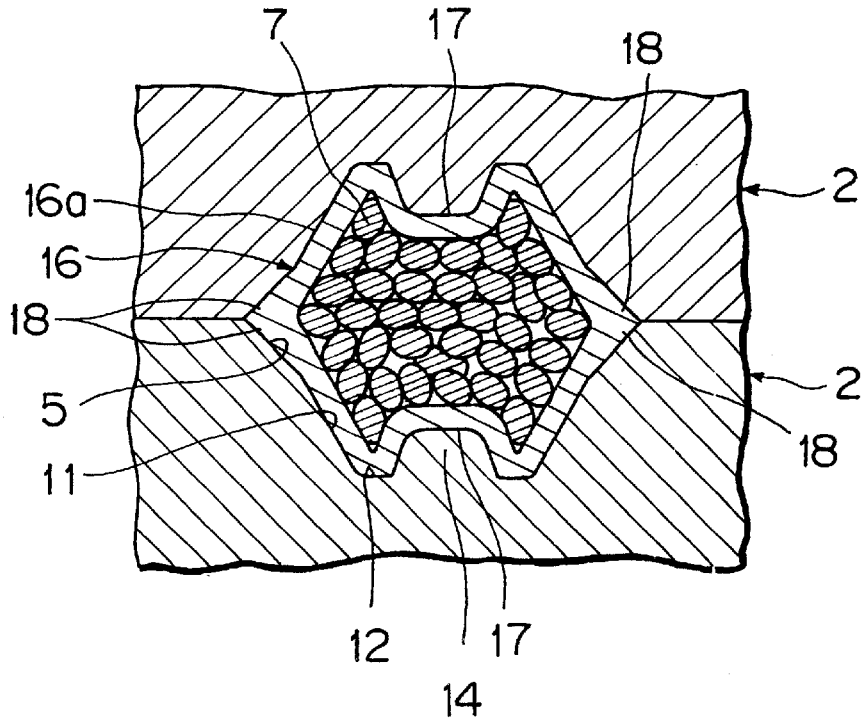
FIG. 7 is a cross-sectional view showing a state that the dies of FIG. 6 have been completely closed each other and a thin portion has been formed on the electrical terminal, which has a substantially hexagonal section.

As shown in FIG. 7, when the couple of dies 2 has been closed completely, the circular electrical terminal 6 is formed into the terminal with a substantially hexagonal section (hereinafter, a substantially hexagonal terminal 16). The substantially hexagonal terminal 16 has a pair of opposite recesses 17 on the outer surface 16*a*. And, a thin portion 18 is formed on the substantially hexagonal terminal 16 by the flash preventing plane 5.

Figure 9A:
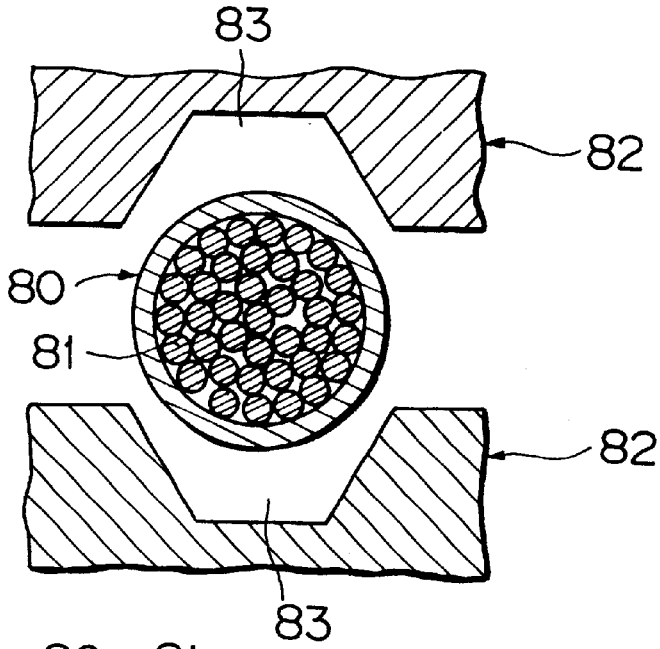
FIG. 9A PRIOR ART
FIG. 9A is a cross-sectional view showing a prior art electrical terminal fastening dies, being in an opened state, with a circular electrical terminal therebetween.
Figure 9B:
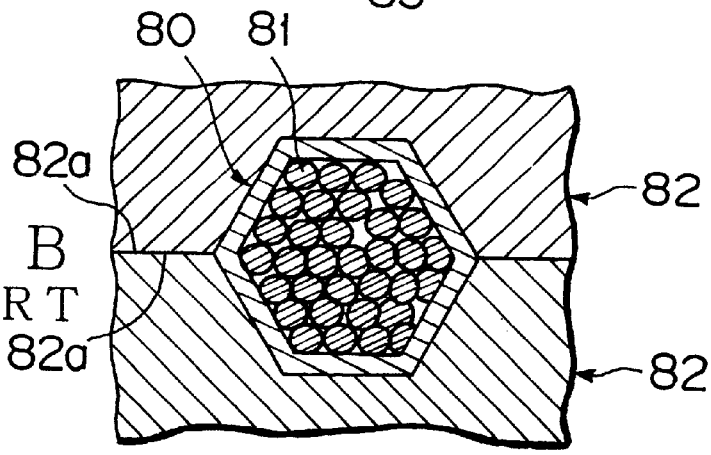
FIG. 9B PRIOR ART
FIG. 9B is a cross-sectional view of the dies of FIG. 9A in a completely closed state.
Figure 9C:
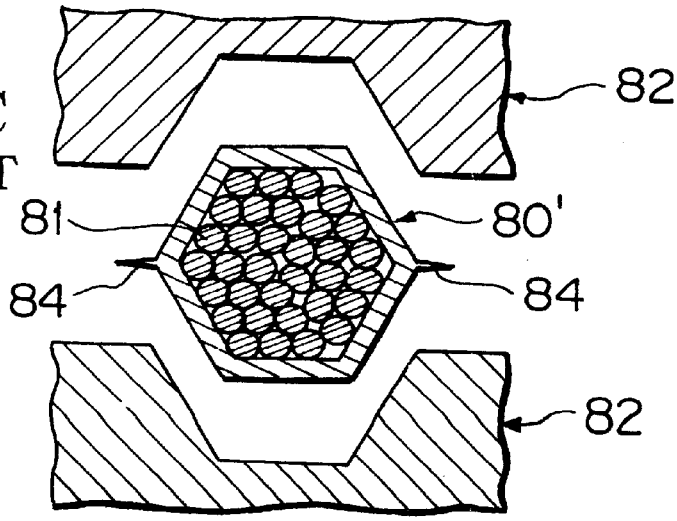
FIG. 9C PRIOR ART
FIG. 9C is a cross-sectional view showing a state that the dies of FIG. 9B are opened again.

As is shown in FIGS. 6 and 7, since the middle portion 6*b* of the circular electrical terminal 6 is pressed inwardly by the flash preventing plane 5, the thin portion 18 of the substantially hexagonal terminal 16 is formed far shorter than the flash 84 of the prior art terminal shown in FIG. 9. And, since the diagonal distance T is specified within a standard width, the substantially hexagonal terminal 16 fastened to the conductor 7 satisfies the standard width. This eliminates a cutting work of the flash 84 (FIG. 9), which work is required for the prior art terminal, and therefore a fastening work of the conductor 7 to the circular electrical terminal 6 can be quickened.

And, the pair of opposite recesses 17 on the outer surface 16*a* of the substantially hexagonal terminal 16 ensure to fasten the conductor 7. And also, since the pair of opposite recesses 17 compress the conductor 7, the substantially hexagonal terminal 16 is put into close contact with the conductor 7, thereby fastening hard the conductor 7.

Figure 8:
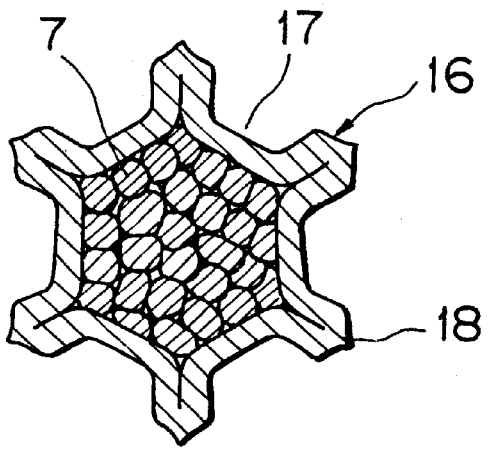
FIG. 8 is a cross-sectional view of the electrical terminal formed by pressing the electrical terminal of FIG. 7 three times every 60 degrees.

After the above work, the conductor 7 with the substantially hexagonal terminal 16 is turned by 60 degrees, and the same fastening work as the above is done. Further, the same fastening work is done after turning the conductor 7 with the substantially hexagonal terminal 16 by 60 degrees. That is, since the fastening work of the conductor 7 is done three times, the thin portion 18 of the substantially hexagonal terminal 16 is almost compressed as shown in FIG. 8. Accordingly, the flash 85 shown in FIG. 9 is not formed and therefore, reliable fastening work of the conductor 7 to the circular electrical terminal 6 can be attained.

Further, since three pairs of recesses 17 are formed on the outer surface 16*a* of the substantially hexagonal terminal 16 with three times of fastening work, the conductor 7 is put into closer contact with the substantially hexagonal terminal 16 and the conductor 7 is still more compressed, thereby steadying the conductor 7 in the substantially hexagonal terminal 16.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. Electric terminal fastening dies arranged to fasten an electric wire in an electric terminal, comprising:

a couple of dies to press the electric wire in the electric terminal in a substantially hexagonal shape in a cross section;

an abutting plane provided on each of said couple of dies;

a substantially hexagonal shaped pressing groove provided on said abutting plane, said abutting plane forming a flat surface with each flat surface abutting each other during pressing;

a pair of terminal pressing planes formed on a surface of said pressing groove of each of said couple of dies for pressing said electric terminal;

a pair of flat flash preventing planes formed on the surface of said pressing groove having said pair of terminal pressing planes, and said pair of flash preventing planes connected to said abutting plane to press said electric terminal to form thin portions, having a wedge-shaped cross-section with two flat planes, thereon so to prevent a formation of flash on pressing of said electric terminal by said couple of dies; and a pressing projection provided on a bottom surface of said pressing groove and in a middle of said pressing groove for forming a pair of opposite recesses on said electric terminal so as to strongly press said electric terminal to said electric wire.

2. The electrical terminal fastening dies according to claim 1, wherein said pair of flash preventing planes each have an inclination nearer a horizontal than that of said pair of terminal pressing planes for surely forming said thin portions;

and a width between the connecting points of said abutting plane and said pair of flash preventing planes is defined equally to a specified dimension of a corresponding part of said electrical terminal after pressing.

* * * * *